US005482247A

United States Patent [19]

Smith

[11] Patent Number: 5,482,247

[45] Date of Patent: Jan. 9, 1996

[54] GOLF CLUB STAND DEVICE

[76] Inventor: Jerry R. Smith, 5690 W. Rowland Ave., Littleton, Colo. 80123

[21] Appl. No.: 133,671

[22] Filed: Oct. 7, 1993

[51] Int. Cl.[6] ..... A63B 53/00

[52] U.S. Cl. ..... 248/688; 273/163 A

[58] Field of Search ..... 248/688, 166; 273/163 A, 183.1, 77 R, 34 R; 211/70.2

[56] References Cited

U.S. PATENT DOCUMENTS

| | | | |
|---|---|---|---|
| 1,331,499 | 2/1920 | Hartford | 273/163 A |
| 3,155,362 | 11/1964 | McCall | 248/688 |
| 4,226,389 | 10/1980 | Neth | 248/166 |
| 4,953,867 | 9/1990 | Rigsby | 273/183 D |
| 5,127,530 | 7/1992 | Ortuno | 211/70.2 |
| 5,230,507 | 7/1993 | White | 211/70.2 X |

FOREIGN PATENT DOCUMENTS

| | | | |
|---|---|---|---|
| 708084 | 4/1965 | Canada | 273/163 A |

*Primary Examiner*—J. Franklin Foss
*Attorney, Agent, or Firm*—Timothy J. Martin

[57] ABSTRACT

A golf club stand device is adapted for use with a conventional golf club employed for striking a golf ball laying on a support surface. The golf club includes a shaft having a shaft end portion attached to a club head. The golf club stand device generally comprises a connector and a leg structure. The connector is adapted to connect to a portion of the shaft of the golf club. The leg structure is secured to the connector and includes a pair of legs. Each leg terminates in a distal end portion and adapts to contact the support surface so that in cooperation with the club head, when it is in contact with the support surface, the golf club is supported in an upright state. The legs are interconnected for common movement and are operative to move relative to the connector between a retracted position and an extended position. In the retracted position, the legs are disposed alongside the shaft of the golf club. In the extended position, each of the legs is disposed at a respective acute angle relative to the shaft of the golf club.

19 Claims, 4 Drawing Sheets

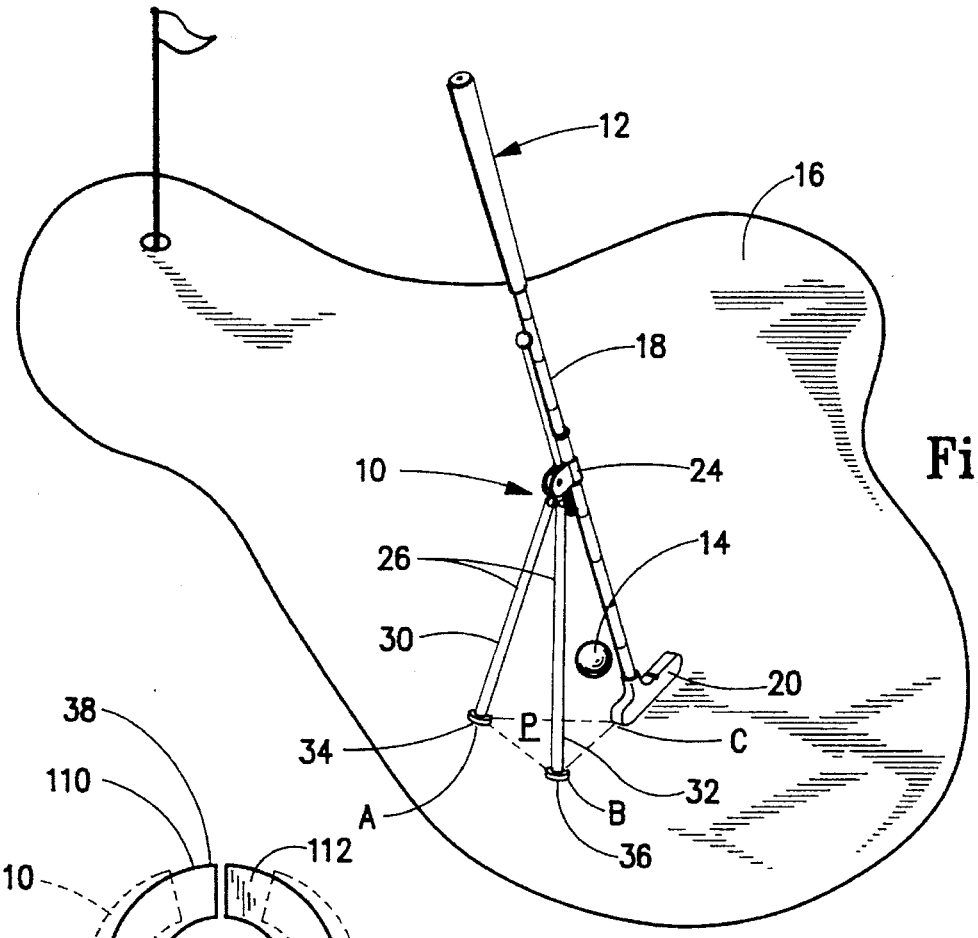
Fig.1
Fig.11
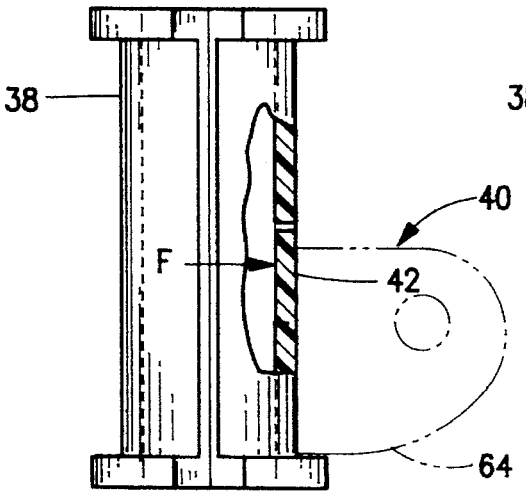
Fig.9
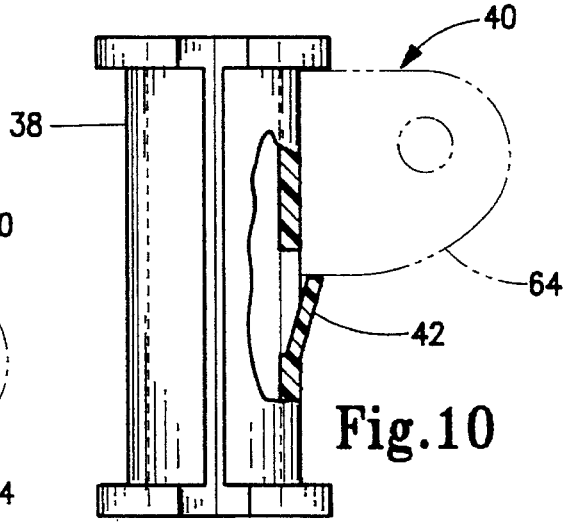
Fig.10

GOLF CLUB STAND DEVICE

FIELD OF THE INVENTION

The present invention broadly relates to a golf club stand device which is adapted for use with a conventional golf club so it can be supported in an upright state on a support surface. The present invention is more particularly directed to a golf club stand device adapted for use with a conventional golf club putter so that a golfer can survey not only the intended line of his/her putt toward the cup but also the alignment of the face of the club head with the intended line of the putt while the putter is supported in an upright state on a golf green.

BACKGROUND OF THE INVENTION

Golf is a game in which a golfer uses special clubs to strike a golf ball with a goal of sinking the golf ball into a sunken cup located on each of successive golf greens with as few strokes as possible. The game of golf grew from its inception as a pastime to its present-day status as competitive professional sport. Today, a professional golfer can earn hundreds of thousands of dollars for winning a single golf tournament. An adage commonly known among professional golfers is "drive for show; putt for dough". This adage implies that in order to be successful at golf, a golfer must become proficient at putting. To illustrate the importance of putting consider a typical eighteen-hole golf course rated at par seventy-two. This means that in order to play at par on such a course, a golfer can strike his/her golf ball only seventy-two times. A general rule of thumb is that the golfer should utilize two putting strokes for each of the eighteen golf greens for a total of thirty-six putting strokes. The remaining thirty-six strokes require the golfer to utilize his/her other golf clubs in order to strike the golf ball to advance it onto the golf greens. By these figures, one could easily see how important putting is to the golfer in order to score well when playing golf.

To putt well, the golfer must consider numerous factors before making his/her putt. Such factors include the amount and direction of the slope of the golf green relative to the golf ball from the sunken cup, the general direction of the grain of the grass, the intended line of travel on which the golf ball will approach the cup after being struck by the putter and various breaks from the intended line of travel that a rolling golf ball may make when approaching the cup due to the contour of the green. Usually, the golfer will consider these factors when standing or crouching behind his/her ball and facing the cup. Surveying these factors while standing or crouching behind the ball and facing the cup affords the golfer a first perspective for determining the intended line of travel of the golf ball to the cup.

Once the golfer determines his/her intended line of travel on which to putt the golf ball to the cup, the golfer, with his/her putter in hand, addresses the golf ball. When addressing the golf ball, the golfer enters into a putting stance. In a typical putting stance, the golfer is slightly hunched over the golf ball and the golfer's feet straddle the golf ball to form an imaginary line which is substantially parallel to the intended line of travel of the putt. Simultaneously, the face of the club head of the putter is aligned substantially perpendicular to the intended line of travel of the putt. While in this putting stance, the golfer usually rotates his/her head to verify that the face of the club head of the putter is appropriately aligned with the intended line of travel of the putt. A second perspective is now observed by the golfer which is different from the first perspective generated while surveying the intended line of travel of the putt as seen from behind the golf ball. When a difference in apparent direction of an object as seen from two different points not on a straight line with the object is observed, a parallax occurs. Parallax is one of several reasons why putting is difficult.

To assist the golfer in minimizing this parallactic problem, a golf club putter was developed that has an enlarged, weighted head. This enlarged, weighted head enables the golf club putter to support itself in an upright state on substantially flat putting surfaces. Now, before surveying the putt, a golfer can align his/her golf club putter with the golf ball on an intended line of travel. During the golfer's survey, the golfer can now determine the intended line of travel of the putt and verify the appropriate alignment of the face of the club head of the putter relative to the intended line of travel. If desired, the self-supporting putter could be adjusted and another survey could be conducted to assure its appropriate alignment of the club face with the intended line of travel of the putt.

Another way of minimizing this parallactic problem is to have a caddy or another golfer stand behind the golf ball and face the cup. The caddy or golfer can now give instructions to the putting golfer for the appropriate alignment. However, golf tournament rules require the caddy or other golfer to step aside before the putting golfer is allowed to strike the golf ball. Unfortunately, the movement of stepping aside could be a distraction to the putting golfer.

For reasons yet to be determined, many golfers become emotionally attached to their putter. Even though an enlarged, weighted putter can afford the golfer an advantage when putting, the typical golfer is not easily dissuaded from using his/her favorite putter. Therefore, a need exists for a golfer who desires to improve the putting aspect of his/her golf game to provide a means by which the golfer can convert his/her own putter to a self-supporting one. It would also be desirable if such a means could be adjustable to facilitate various slopes in the terrain of the golf green. The present invention is directed to such a device.

SUMMARY OF THE INVENTION

It is an object of the present invention to provide a new and useful golf club stand device which can be connected to any conventional golf club so that it can be supported in an upright state on a support surface.

It is a further object of the present invention to provide a golf club stand device having legs which can be moved into an extended position for supporting the golf club on a support surface and into a retracted position just before using the golf club to strike the golf ball.

It is another object of the present invention to provide a golf club stand device in which the legs can be moved from the extended position to the retracted position by the golfer without substantially changing his/her putting stance.

It is another object of the present invention to provide a golf club stand device which is generally unobtrusive to a golfer when putting.

Yet another object of the present invention is to provide a golf club stand device which is sufficiently light-weight thereby minimizing any change in the feel of the golf club to the golfer.

Still a further object of the present invention is to provide a golf club stand device which can be adapted for use on sloped surfaces.

According to the present invention, a golf club stand device is described which is adapted for use with a conventional golf club employed for striking a golf ball laying on a support surface. The golf club stand device includes a shaft that has a shaft end portion attached to a club head. Broadly, the golf club stand device comprises a connector and a leg structure. The connector adapts to connect to a portion of the shaft of the golf club. The leg structure is secured to the connector and includes a pair of legs. Each leg terminates in a distal end portion and adapts to contact the support surface so that, in cooperation with the club head of the golf club when it contacts the support surface, the golf club is supported in an upright state. The distal end portions and the club head, when supporting the golf club in the upright state, form three points of contact with the support surface to define a support plane.

Each leg has a proximal end portion opposite its respective distal end portion and the proximal end portions are connected to the connector. It is preferred that the respective proximal end portions are pivotally connected to the connector. The legs are operative to move relative to the connector between a retracted position and an extended position. In the retracted position, the legs are disposed alongside of the shaft of the golf club. In the extended position, each of the legs is disposed at a respective acute angle relative to the shaft of the golf club. Further, the legs are interconnected for common movement between the retracted position and the extended position. The distal end portions of the legs are located proximate each other when the legs are in the retracted position. The distal end portions of the legs move apart from one another when the legs move into the extended position.

The connector includes an anchor structure and a leg positioning assembly. The anchor structure is secured to the shaft of the golf club. The leg positioning assembly is movably connected to the anchor structure. The leg positioning assembly is slidably and rotatably mounted onto the anchor structure so that the leg positioning assembly can reciprocate between an upper position on the anchor structure when the pair of legs are in the retracted position and a lower position on the anchor structure when the pair of legs are in the extended position.

The anchor structure includes a button latch which is resiliently biased outwardly from the anchor structure. When the leg positioning assembly is in the lower position, the button latch is operative to impart a force against the leg positioning assembly to resist slidable movement of the leg positioning assembly from the lower position to the upper position. When the leg positioning assembly is in the upper position, the button latch operates to prevent slidable movement of the leg positioning assembly from the upper position to the lower position.

The leg positioning assembly includes a gear element and a driver element. The driver element is operatably connected to the gear element so that actuating the driver element in a first rectilinear direction along the shaft rotates the gear in a first angular direction causing the legs to move to the retracted position. Further, the driver element is operatably connected to the gear element so that actuating the driver element in a second rectilinear direction along the shaft opposite the first rectilinear direction rotates the gear element in a second angular direction opposite the first angular direction causing the pair of legs to move to the extended position.

These and other objects of the present invention will become more readily appreciated and understood from a consideration of the following detailed description of the preferred embodiment when taken together with the accompanying drawings, in which:

BRIEF DESCRIPTION OF THE DRAWINGS

FIG. 1 is a perspective view of a golf club stand device according to a preferred embodiment of the present invention supporting a conventional golf club putter in an upright state on a typical golf green used for putting;

FIG. 9 is a side elevational view of an anchor structure partially broken-away showing in phantom the leg positioning assembly in a lower position;

FIG. 10 is a side elevational view of the anchor structure partially broken-away showing in phantom the leg positioning assembly retained in an upper position by a button latch; and FIG. 11 is a top plan view of the anchor structure of FIGS. 9 and 10 shown in its closed condition and, in phantom, its open condition immediately before being secured onto a shaft of a golf club.

DETAILED DESCRIPTION OF THE PREFERRED EMBODIMENT

The present invention relates to a golf club stand device which is adapted for use with a conventional golf club. Generally, the golf club stand device of the present invention is used to support the conventional golf club in an upright state on a support surface so that a golfer may survey and properly align the face of a club head with an intended line of travel of the golf ball. The following detailed description of the preferred embodiment describes the golf club stand device of the present invention in use with a conventional golf club putter for putting on putting greens. However, it should be appreciated that the golf club stand device of the present invention can be used with other conventional golf clubs and on other types of support surfaces such as tee boxes, roughs, fairways or the like.

Figure 2:
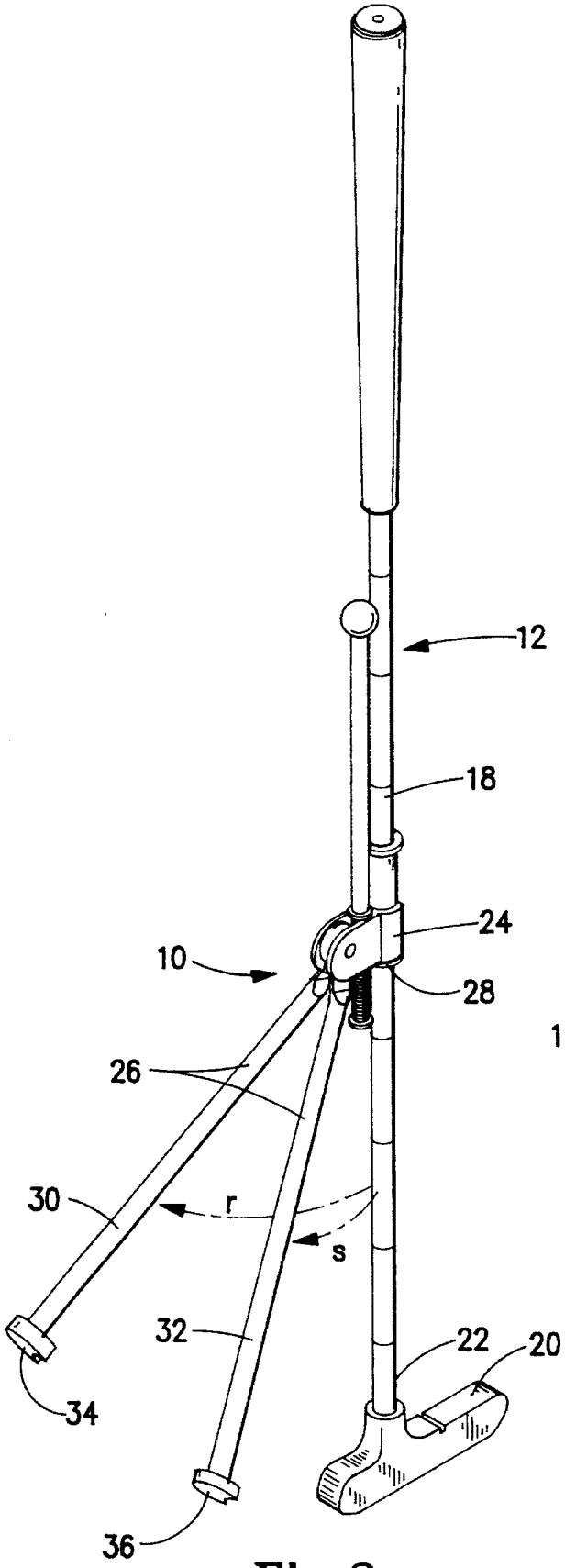
FIG. 2 is a perspective view of the conventional golf club putter having the golf club stand device connected thereto as shown in FIG. 1 with its legs disposed in an extended position.
Figure 3:
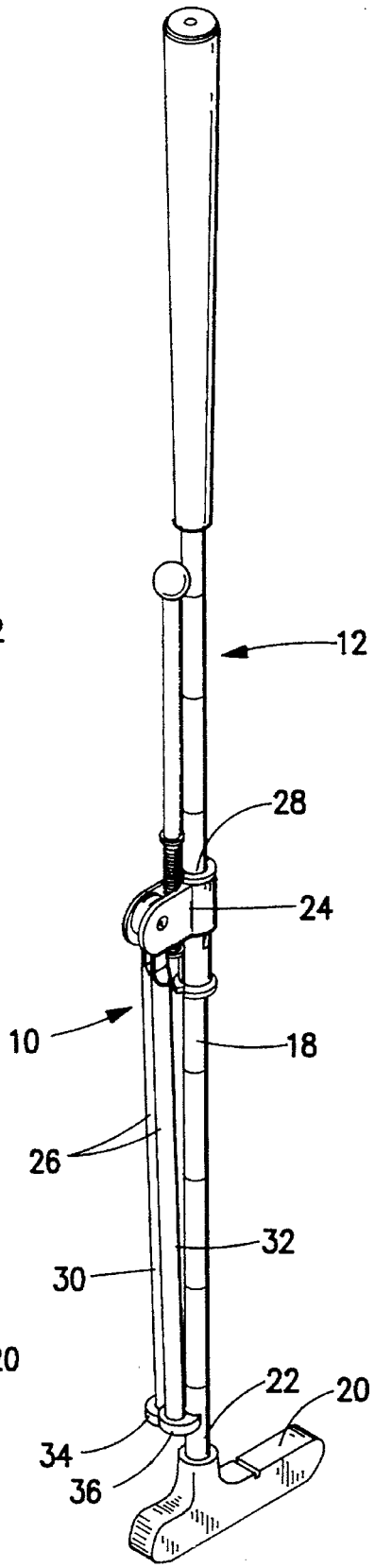
FIG. 3 is a perspective view of the conventional golf club putter having the golf club stand device connected thereto as shown in FIG. 2 with its legs disposed in a retracted position.

A preferred embodiment of a golf club stand device 10 of the present invention is generally shown in FIGS. 1–3. The golf club stand device 10 is adapted for use with a conventional golf club 12 which is employed for striking a golf ball 14 laying on a support surface 16 such as a putting green. Conventional golf club 12 has a shaft 18 and a club head 20 which is attached to shaft 18 at a shaft end portion 22.

Broadly, golf club stand device 10 comprises a connector 24 and a leg structure 26. Connector 24 is adapted to connect to a portion 28 of shaft 18 of conventional golf club 12. Leg structure 26 is secured to connector 24 and includes a pair of legs 30, 32. Each of leg 30 and 32 respectively terminates in a distal end portion 34 and 36 which to contact support surface 16 so that, in cooperation with club head 20, golf club 12 is supported in an upright state as shown in FIG. 1. Distal end portions 34, 36 and club head 20, when supporting conventional golf club 12 in the upright state, form three points of contact "A", "B", and "C", with support surface 16 to define a support plane "P".

Figure 4:
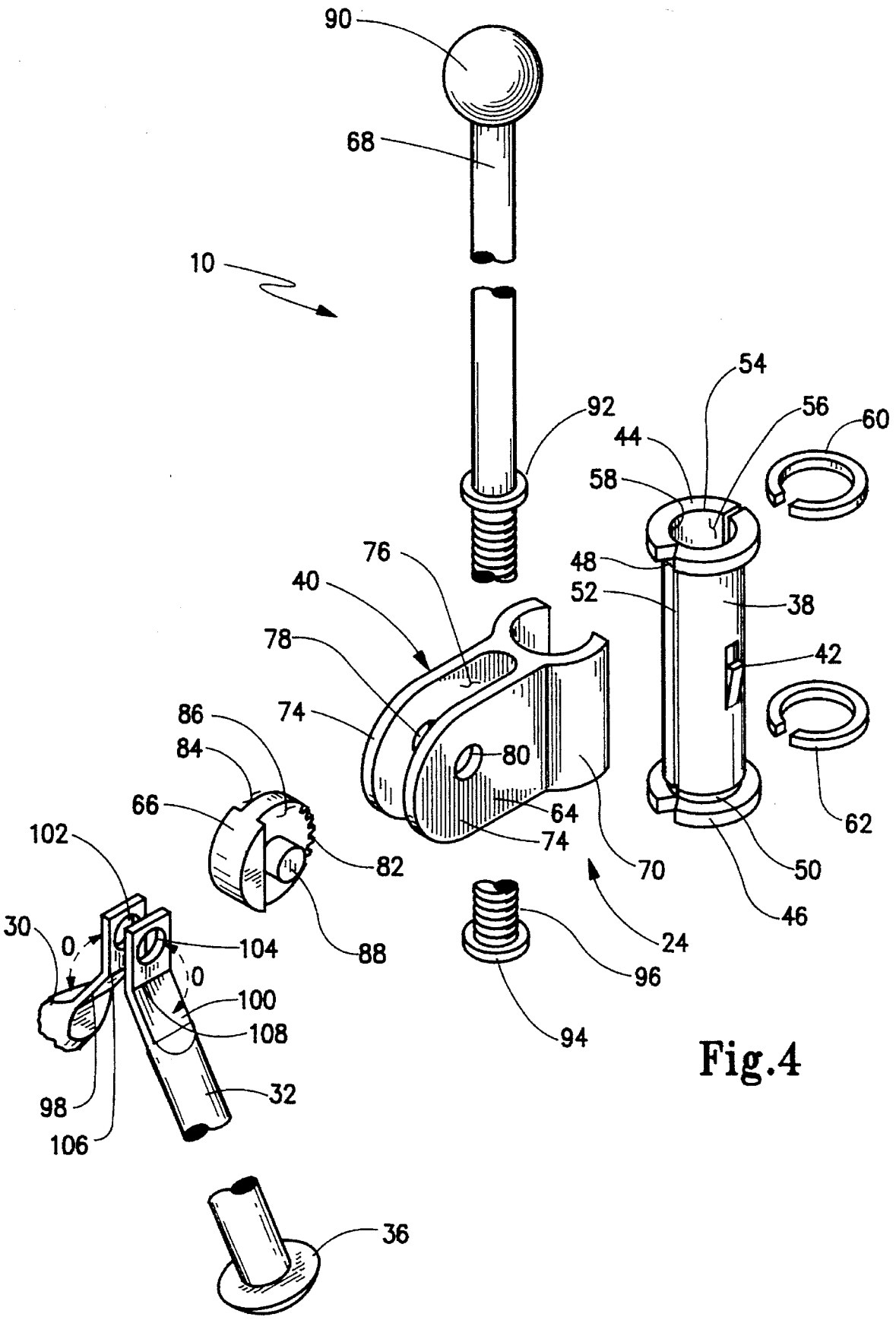
FIG. 4 is an exploded perspective view of the golf club stand device shown in FIGS. 1, 2 and 3.

Details of golf club stand device 10 of the present invention is best shown in FIG. 4. Connector 24 includes an anchor structure 38 and a leg positioning assembly 40. Anchor structure 38 includes a button latch 42 which is resiliently biased outwardly from anchor structure 38 and a pair of flanges 44, 46 which are disposed at opposite ends of anchor structure 38. A pair of circumferential grooves 48, 50 are formed into anchor structure 38. Each groove 48, 50 is located proximate a respective flange 44, 46. An anchor hinge 52 extends between and through the pair of flanges 44, 46 so that anchor structure 38 can open to receive shaft 18. Opening and closing anchor structure 38 is further described hereinbelow. An inner cylindrical wall 54 defines a cylindrical opening 56 through anchor structure 38. It is preferable that inner cylindrical 54 be lined with a resilient-like material 58 such as rubber to facilitate frictional engagement of anchor structure 38 onto shaft 18. In the alternative, inner cylinder 54 can be coated with a sticky substance to facilitate the connection of anchor structure 38 onto shaft 18. A pair of spring clips 60, 62 are sized to snugly fit about the pair of grooves 48 50, respectively to retain anchor structure 38 in a closed condition around shaft 18.

The leg positioning assembly 40 includes a runner element 64, a gear element 66 and a driver element 68. The runner element 64 has a U-shaped portion 70 which adapts to connect to anchor structure 38. The runner element 64 also has a pair of ears 72, 74 which extend from U-shaped portion 70 in a space-apart relationship to form a channel 76. Each ear 72, 74 has a hole 78, 80, respectively, which are coaxially aligned with each other. Holes 78, 80 extend through each ear 72, 74 respectively and communicate with channel 76.

Gear element 66 includes a plurality of gear teeth 82 which project radially along a peripheral portion of gear element 66. A pair of diametrical channels 84, 86 oriented parallel to one another are formed into opposite faces of gear element 66. A gear shaft 88 extends axially through gear element 66 and through and within diametrical channels 84, 86.

Driver element 68 has a spherical knob 90 attached at one end and a pair of stops 92, 94 positioned at the other end. Stops 92, 94 are disposed in a space-apart relationship with respect to one another to define a toothed portion 96 of driver element 68 therebetween.

Each of legs 30, 32 has a proximal end portion 98 which is located opposite respective distal end portions 34 and 36. Proximal end portions 98, 100 of legs 30, 32 are to be connected to connector 24 and each has a respective gear-shaft receiving hole 102, 104 extending therethrough. Each proximal end portion 98, 100 includes a leg hinge 106, 108 respectively and is formed at an obtuse angle "o" relative to leg hinges 106, 108. Forming proximal end portions 98, 100 at obtuse angle "o" during the molding process naturally causes legs 30, 32 to be resiliently biased outwardly.

Figure 5:
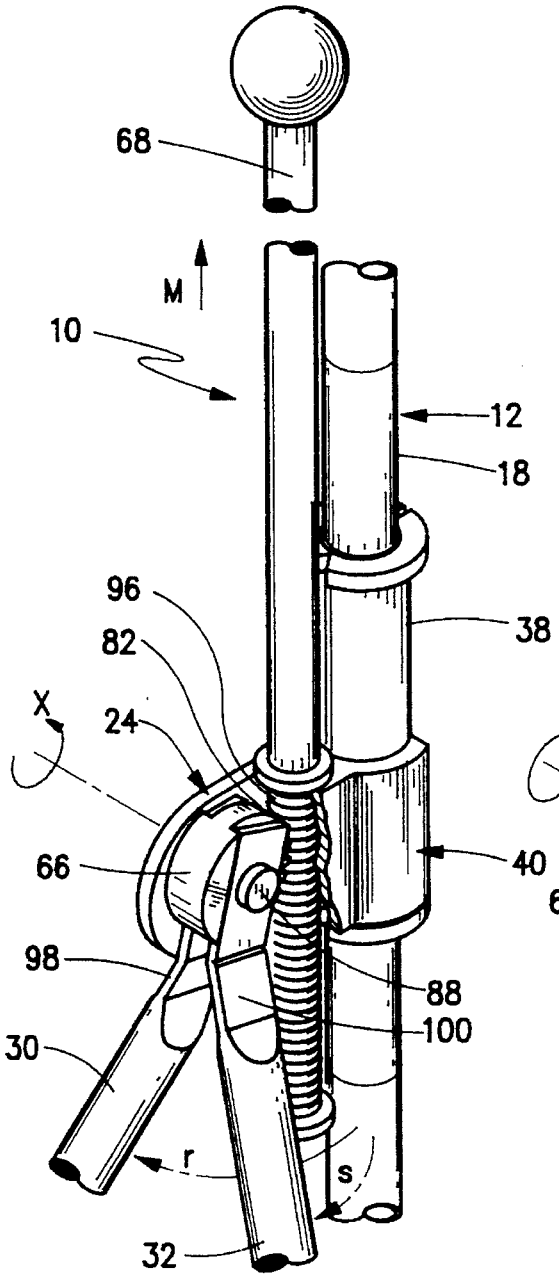
FIG. 5 is an enlarged perspective view of the golf club stand device of the present invention partially broken away to show the assembly and operation of the golf club stand device of FIG. 4 with its legs disposed in the extended position.
Figure 6:
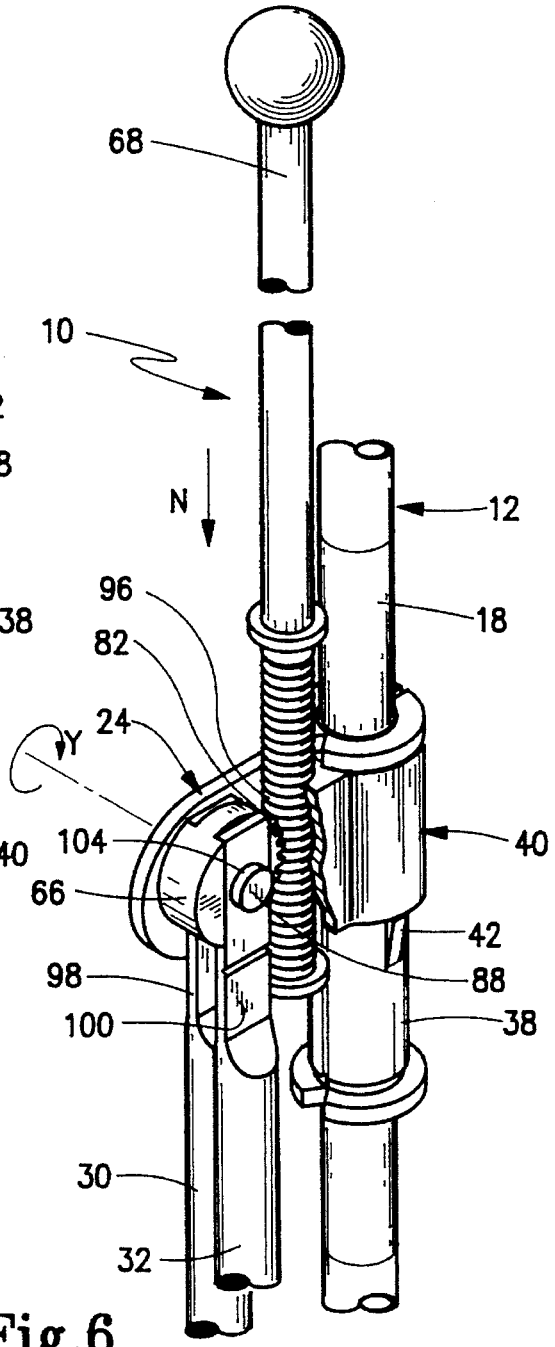
FIG. 6 is an enlarged perspective view of the golf club stand device of the present invention partially broken-away to show the assembly and operation of the golf club stand device of FIG. 4 with its legs disposed in the retracted position.
Figure 7:
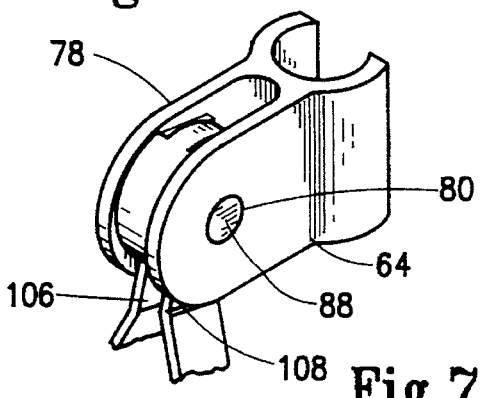
FIG. 7 is an enlarged perspective view of a leg positioning assembly of FIG. 5 showing the outboard location of a pair of leg hinges relative to a pair of ears of the leg positioning assembly.
Figure 8:
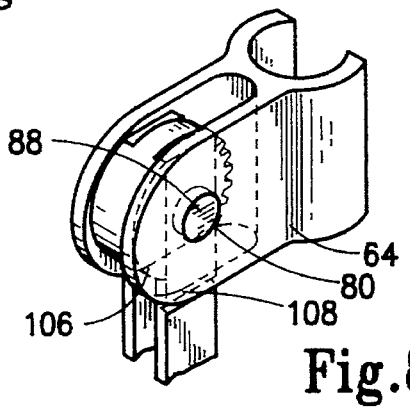
FIG. 8 is an enlarged perspective view of the leg positioning assembly of FIG. 6 showing the inboard location of the pair of hinges relative to the pair of ears of the leg positioning assembly.

Assembly and operation of the golf club stand device 10 of the present invention is best depicted in FIGS. 5–8. With reference to FIGS. 5 and 6, anchor structure 38 is secured to shaft 18 of conventional golf club 12. Leg positioning assembly 40 of connector 24 is slidably and rotatably mounted onto anchor structure 38. Proximal end portions 98, 100 of legs 30, 32, respectively, are pivotally connected to connector 24. Specifically, proximal end portion 98, 100 of legs 30, 32 are connected to gear element 66. Gear shaft 88 extends through gear shaft receiving holes 102, 104. Proximal end portions 98, 100 are received by diametric channels 84, 86, respectively. As best shown in FIGS. 7 and 8, gear shaft 88 is rotatably mounted in holes 78, 80 formed in ears 72, 74 of runner element 64. Now, legs 30, 32 are operative to move relative to connector 24 between a retracted position (FIGS. 3 and 6) and an extended position (FIGS. 1, 2 and 5). In the retracted position, (FIGS. 3 and 6), legs 30, 32 are disposed alongside of shaft 18 of conventional golf club 12. In the extended position (FIGS. 1, 2 and 5), each leg 30, 32 is disposed at a respective acute angle "r" and "s" relative to shaft 18 of conventional golf club 12.

Although not by way of limitation, legs 30, 32 are interconnected to connector 24 for common movement between the retracted position and the extended position. Additionally, distal end portions 34, 36 are located proximate each other when legs 30, 32 are in the retracted position as shown in FIG. 3 and distal end portions 34, 36 move apart from one another when legs 34, 36 move into the extended position as shown in FIGS. 1 and 2. Further, in the retracted position, leg hinges 106, 108 are disposed within channel 76 as shown in FIG. 8; in the extended position, leg hinges 106 and 108 are disposed outside of channel 76 as shown in FIG. 9. One of ordinary skill in the art would appreciate that, in the retracted position, ears 72, 74 cause distal end portions 34, 36 to be located proximate each other and, in the extended state, legs 30, 32 automatically move into the extended state when leg hinges 106, 108 are no longer contained within channel 76.

Leg positioning assembly 40 is both slidably and rotatably mounted onto anchor structure 38. Leg positioning assembly 40 is slidably mounted on anchor structure 38 so that leg positioning assembly 40 reciprocates between a lower position as shown in FIG. 5 and an upward position as shown in FIG. 6. For purposes of describing the preferred embodiment of the present invention and not by way of limitation, in the lower position shown in FIG. 5, legs 30, 32 are in the extended position and, in the upper position shown in FIG. 6, legs 30, 32 are in the retracted position. This feature enables legs 30, 32 to be lifted a certain distance when moving between the extended state and the retracted state so that distal end portions 34, 36 can clear club head 20 as shown in FIG. 3. Leg positioning assembly 40 is rotatably connected to anchor structure 38 so that it can rotate 360° to orient the legs at any desired position about the anchor structure. An advantage of this feature is that the legs 30, 32 can be positioned anywhere around the shaft of the golf club putter to better facilitate the use of the present invention on sloped putting surfaces.

As best shown in FIGS. 5 and 6, driver element 68 is operably connected to gear element 66. Specifically, the plurality of gear teeth 82 of gear element 66 operatively engages with tooth portion 96 of driver element 68 which forms a geared rack for rotating gear element 68. Actuating driver element 68 in a first rectilinear direction shown by an arrow "M" in FIG. 5 along shaft 18 rotates gear element 66 in a first angular direction "x" causing legs 30, 32 to move to the retracted position as shown in FIG. 6. Also, actuating driver element 68 in the first rectilinear direction "M" along shaft 18 slides leg positioning assembly 40 from its lower position shown in FIG. 5 to its upper position shown in FIG. 6. Actuating driver element 68 in a second rectilinear direction shown by arrow "N" in FIG. 6 along shaft 18 which is opposite the first rectilinear direction "M" rotates gear element 66 in a second angular direction "y" which is opposite the first angular direction "x" causing legs 30, 32 to move to the extended position as shown in FIG. 5. However, latch button 42 of anchor structure 38 prevents leg positioning assembly 40 from moving from the upper position to the lower position. Stops 92, 94 restrict both the angular movement of gear element 66 and rectilinear movement of driver element 68 when the stops abut runner element 64.

Operation of latch button 42 of anchor structure 38 is best shown in FIGS. 9 and 10. Latch button 42 is operative with leg positioning assembly 40 represented in phantom by runner element 64. When leg positioning assembly 40 is in the lower position as shown in FIG. 9, latch button 42 imparts a force against leg positioning assembly 40 to resist slidable movement of leg positioning assembly 40 from the lower position (FIG. 9) to the upper position (FIG. 10). This force also assists in preventing rotational movement of the leg positioning assembly about the anchor structure. When leg positioning assembly 40 is in the upper position (FIG. 10) latch button 42 operates to prevent slidable movement of leg positioning assembly 40 from the upper position to the lower position.

In FIG. 11, anchor structure 38 is molded as two half portions 110, 112. Half portions 110, 112 pivot along and about anchor hinge 52 so that the shaft of the conventional golf club can be received into cylindrical opening 56 of anchor structure 38. Since anchor structure 38 is molded in a closed condition, spring clips 60, 62 (as shown in FIG. 4) may be used at the option of the golfer to help secure the anchor structure onto the shaft of the golf club but are not critical to enjoy the benefits of the present invention.

As a result of the golf club stand device of the present invention, a golfer can utilize his/her favorite putter and support it in an upright state on a green. The golf club stand device enables a golfer to support his/her favorite putter in an upright state on a golf green to assist the golfer in aligning his/her putts. Simply by reaching slightly below the handle of the putter, the golfer can move the legs from the extended position to the retracted position without substantially changing his/her putting stance. When retracted, the golf club stand device is generally unobtrusive to a putting golfer when putting. The golf club stand device is constructed from light-weight polymeric material such as plastic. Being light-weight, the golf club stand device has a minimal effect in the feel of the golf club to the golfer. And when a golfer is on a sloped support surface, the legs can be adjusted either by rotating the leg positioning assembly about the anchor portion or one leg can be pivoted by hand greater than either acute angle "r" or "s" to facilitate supporting the golf club on the sloped support surface.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A golf club stand device adapted for use with a conventional golf club employed for striking a golf ball laying on a support surface, the golf club including a shaft having a shaft end portion attached to a club head, the golf club stand device comprising:

(a) a connector adapted to connect to a portion of the shaft of the golf club; and (b) a leg structure secured to said connector and including a pair of legs, each of said legs terminating in a distal end portion and adapted to contact the support surface in a non-penetrating manners so that, in cooperation with the club head when in contact with the support surface, the golf club is supported in an upright state.

2. A golf club stand device according to claim 1 wherein said distal end portions and said club head, when supporting the golf club in the upright state, form three points of contact with the support surface to define a support plane.

3. A golf club stand device according to claim 1 wherein each of said legs has a proximal end portion opposite its respective distal end portion, said proximal end portions being connected to said connector.

4. A golf club stand device according to claim 3 wherein said respective proximal end portions are pivotally connected to said connector.

5. A golf club stand device according to claim 4 wherein said legs are operative to move relative to said connector between a retracted position whereby said legs are disposed alongside of the shaft of the golf club and an extended position whereby each of said legs is disposed at a respective acute angle relative to the shaft of the golf club.

6. A golf club stand device according to claim 5 wherein said legs are interconnected for common movement between the retracted position and the extended position.

7. A golf club stand device according to claim 6 wherein said distal end portions are located proximate to each other when said legs are in the retracted position and wherein said distal end portions move apart from one another when said legs move into the extended position.

8. A golf club stand device adapted for use with a conventional golf club employed for striking a golf ball laying on a support surface, the golf club including a shaft having a shaft end portion attached to a club head, the golf club stand device comprising:

(a) an anchor structure secured to a portion of the shaft of the golf club;

(b) a leg positioning assembly movably connected to said anchor structure; and (c) a pair of legs secured to said leg positioning assembly, each of said legs terminating in a distal end portion and adapted to contact the support surface in a non-penetrating manner so that, in cooperation with the club head when in contact with the support surface, the golf club is supported in an upright state.

9. A golf club stand device according to claim 8 wherein said distal end portions and said club head, when supporting the golf club in the upright state, form three points of contact with the support surface to define a support plane.

10. A golf club stand device according to claim 9 wherein each of said legs has a proximal end portion opposite its respective distal end portion, said proximal end portions being pivotally connected to said leg positioning assembly.

11. A golf club stand device according to claim 10 wherein said legs are operative to move relative to said leg positioning assembly between a retracted position whereby said legs are disposed alongside of the shaft of the golf club and an extended position whereby each of said legs is disposed at a respective acute angle relative to the shaft of the golf club and wherein said legs are interconnected for common movement between the retracted position and the extended position.

12. A golf club stand device according to claim 11 wherein said leg positioning assembly includes a gear element and a driver element operably connected to said gear element so that actuating the driver element in a first rectilinear direction along the shaft rotates said gear in a first angular direction causing said legs to move to the retracted position and actuating the driver element in a second rectilinear direction along the shaft opposite said first rectilinear direction rotates said gear element in a second angular direction opposite said first angular direction causing said legs to move to the extended position.

13. A golf club stand device according to claim 11 wherein said distal end portions are located proximate each other when said legs are in the retracted position and wherein said distal end portions move apart from one another when said legs move into the extended position.

14. A golf club stand device according to claim 13 wherein said leg positioning assembly is slidably and rotatably mounted onto said anchor structure so that said leg positioning assembly reciprocates between an upper position and a lower position on said anchor structure.

15. A golf club stand device according to claim 14 wherein said anchor structure includes a button latch resiliently biased outwardly from said anchor structure and operative, when said leg positioning assembly is in the lower position, to impart a force against said leg positioning assembly to resist slidable movement of said leg positioning assembly from the lower position to the upper position and, when said leg positioning assembly is in the upper position, to prevent slidable movement of said leg positioning assembly from the upper position to the lower position.

16. A golf club stand device adapted for use with a conventional golf club employed for striking a golf ball laying on a support surface, the golf club including a shaft having a shaft end portion attached to a club head, the golf club stand device comprising:

(a) a connector adapted to connect to a portion of said shaft and including an anchor structure secured to the shaft and a leg positioning assembly slidably and rotatably mounted to said anchor structure so that said leg positioning assembly reciprocates between an upper position on said anchor structure and a lower position on said anchor structure; and (b) a pair of legs each terminating in a distal end portion and adapted to contact said support surface so that, in cooperation with the club head in contact with the support surface, the golf club is supported in an upright state, said pair of legs mounted to said connector and operative to move relative to said connector between a retracted position when said leg positioning assembly is in the upper position on said anchor structure whereby said legs are disposed alongside said shaft and an extended position when said leg positioning assembly is in the lower position on said anchor structure whereby each of said legs is disposed at an acute angle relative to said shaft.

17. A golf club stand device according to claim 5 wherein said connector includes a latch structure operative in a first state to resist movement of said legs between the retracted position and the extended position and operative in a second state to enable movement of said legs between the retracted position and the extended position.

18. A golf club stand device according to claim 17 wherein said anchor structure includes a button latch resiliently biased outwardly from said anchor structure and is operative, when said leg positioning assembly is in the lower position, to impart a force against said leg positioning assembly to resist slidable movement of said leg positioning assembly from the lower position to the upper position and, when said leg positioning assembly is in the upper position, to prevent slidable movement of said leg positioning assembly from the upper position to the lower position.

19. A golf club stand device according to claim 17 wherein said leg positioning assembly includes a gear element and a driver element operably connected to said gear element so that actuating the driver element in a first rectilinear direction along the shaft rotates said gear in a first angular direction causing said legs to move to the retracted position and actuating the driver element in a second rectilinear direction along the shaft opposite said first rectilinear direction rotates said gear element in a second angular direction opposite said first angular direction causing said legs to move to the extended position.

* * * * *